US007886517B2

(12) United States Patent
Chopra et al.

(10) Patent No.: US 7,886,517 B2
(45) Date of Patent: Feb. 15, 2011

(54) IMPINGEMENT JETS COUPLED TO COOLING CHANNELS FOR TRANSITION COOLING

(75) Inventors: Sanjay Chopra, Orlando, FL (US); Bradley T. Youngblood, Oviedo, FL (US); Robert W. Dawson, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 951 days.

(21) Appl. No.: 11/801,306

(22) Filed: May 9, 2007

(65) Prior Publication Data

US 2008/0276619 A1 Nov. 13, 2008

(51) Int. Cl.
*F23R 3/42* (2006.01)
*F23R 3/46* (2006.01)

(52) U.S. Cl. ..... 60/39.37; 60/752; 60/754

(58) Field of Classification Search ..... 60/752, 60/754, 760, 39.37
See application file for complete search history.

(56) References Cited

U.S. PATENT DOCUMENTS

| | | | | |
|---|---|---|---|---|
| 3,652,181 | A | 3/1972 | Wilhelm, Jr. | |
| 4,446,693 | A * | 5/1984 | Pidcock et al. | 60/800 |
| 4,695,247 | A | 9/1987 | Enzaki et al. | |
| 4,719,748 | A | 1/1988 | Davis, Jr. et al. | |
| 5,528,904 | A | 6/1996 | Jones et al. | |
| 5,605,046 | A * | 2/1997 | Liang | 60/752 |
| 6,602,053 | B2 | 8/2003 | Subramanian et al. | |
| 6,837,050 | B2 * | 1/2005 | Mandai et al. | 60/757 |
| 6,964,170 | B2 | 11/2005 | Alkabie | |
| 6,981,358 | B2 * | 1/2006 | Bellucci et al. | 60/754 |
| 2001/0004835 | A1 | 6/2001 | Alkabie et al. | |
| 2002/0152740 | A1 * | 10/2002 | Suenaga et al. | 60/39.23 |
| 2006/0130484 | A1 * | 6/2006 | Marcum et al. | 60/752 |

* cited by examiner

*Primary Examiner*—Ted Kim

(57) ABSTRACT

Embodiments of a transition (400) of the present invention comprise a cooling channel (20, 30, 410) defined in part by an outer wall (23) and an inner wall (24). The cooling channel (20, 30, 410) also comprises lateral side walls (33, 34). Two or more subdomains (AA, BB, A, $B_1$, $B_2$, $C_1$, $C_2$, D) of impingement jets (25, 35) are provided through the outer wall (23), and one or more metering outlets (26, 36, 37, 38) is provided through the inner wall (24), all communicating with a respective channel (20, 30, 410). The impingement jets of each respective subdomain are designed to supply cooling fluid to one of the one or more metering outlets. Further to the impingement jets (25, 35) their size, shape, spacing, and arrangement with regard to the metering outlet (26, 36, 37, 38) are such that a desired cooling of the inner wall (24) is provided during normal gas turbine operations through advantageous impingement cooling at points along the surface of the inner wall (24) that defines the cooling channel (20, 30, 410).

10 Claims, 3 Drawing Sheets

IMPINGEMENT JETS COUPLED TO COOLING CHANNELS FOR TRANSITION COOLING

FIELD OF INVENTION

The invention generally relates to a gas turbine engine, and more particularly to a transition comprising cooling channels associated with impingement jets and metering outlets.

BACKGROUND OF THE INVENTION

In gas turbine engines, air is compressed at an initial stage, then is heated in combustion chambers, and the hot gas so produced passes to a turbine that, driven by the hot gas, does work which may include rotating the air compressor.

In a typical industrial gas turbine engine a number of combustion chambers combust fuel and hot gas flowing from these combustion chambers is passed via respective transitions to respective entrances of the turbine. More specifically, a plurality of combustion chambers commonly are arranged radially about a longitudinal axis of the gas turbine engine, and likewise radially arranged transitions comprise outlet ends that converge to form an annular inflow of hot gas to the turbine entrance. Each transition has a generally tubular structure so as to present a walled structure defining and surrounding a hot gas path between a respective combustion chamber and a respective entrance of the turbine.

Whether a transition is found in such gas turbine engine configuration or another design, it is subject to relatively high temperatures from the combusted and combusting gases passing from the combustion chamber. Considering its position between other dynamic components, temperature cycling, and other factors, the transition also is subject to low cycle fatigue. This is recognized to be a major design consideration for component life cycle.

Transitions may be cooled by open or closed cooling using compressed air from the turbine compressor, by steam, or by other approaches. Various designs of channels are known for passage of cooling fluids in the wall of the transition. The interior surface of the transition also may be coated with a thermal barrier coating such as are known to those skilled in the art.

One example of a prior art approach to cooling a transition is exemplified in U.S. Pat. No. 4,719,748, issued Jan. 19, 1988 to Davis et al. A separate sleeve extending over a transition is configured so as to provide impingement jets formed by apertures in the sleeve, and the sleeve is configured to duct spent impingement air toward the combustor. The spent impingement air mixes with other air not used for impingement cooling, and can be used for combustion. It is stated that the distance between the impingement sleeve and the transition duct surface is varied to control the velocity of air cross-flow from spent impingement air in order to minimize pressure loss due to cross-flow.

Not only is the overall cooling of a transition of concern; a specific cooling approach for the more downstream region of a transition has been proposed. U.S. Pat. No. 3,652,181, issued Mar. 28, 1972 to Wilhelm, teaches cooling of the more downstream end of a transition by means of a surrounding sleeve which admits cooling fluid (compressed air) exteriorly into the sleeve. The cooling fluid enters through inlet holes distributed with respect to a surface of an upper transition wall, and passes laterally around the transition, flowing in both directions around the sides of the transition, to exit through holes that allow the cooling fluid to enter an interior hot gas path defined by the transition.

Other approaches include those described in U.S. Patent Publication No. 2001/0004835, published Jun. 28, 2001, U.S. Pat. No. 6,964,170, issued Nov. 15, 2005, U.S. Pat. No. 4,695,247, issued Sep. 22, 1987, and U.S. Pat. No. 5,528,904, issued Jun. 25, 1996. The latter two patents provide approaches that include a film cooling component to cooling a combustor or hot gas duct liner, respectively.

Notwithstanding these and other approaches to cool transitions, there remains a need to provide an approach for more effective cooling of transitions used for gas turbine engines.

BRIEF DESCRIPTION OF THE DRAWINGS

The invention is explained in following description in view of the drawings that show.

DETAILED DESCRIPTION OF EMBODIMENTS OF THE INVENTION

Figure 1A:
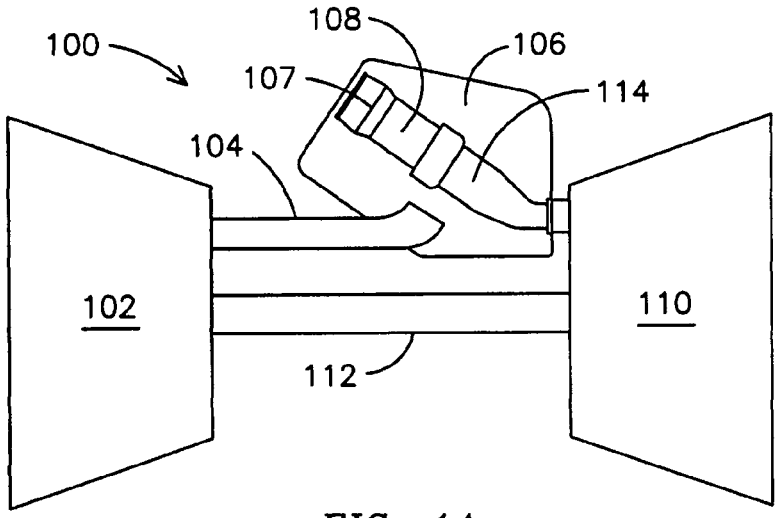
FIG. 1A (PRIOR ART)
FIG. 1A provides a schematic cross-sectional depiction of a prior art gas turbine engine.

Embodiments of the invention provide a number of advances over known approaches to cool a transition or other walled body in need of cooling. Embodiments provide more uniform, and post-installation customizable, cooling of a transition through use of transition cooling channels, each of which is associated with a plurality of impingement jets communicating between an exterior source of cooling fluid and the cooling channel, wherein the cooling channel also is associated with, along its length, one or more metering outlets (also referred to as sink holes) that communicate with the hot gas path within the transition. In various embodiments, a particular metering outlet is adapted to receive cooling fluid from one or more subdomains of impingement jets, such as from different directions of the channel, wherein each subdomain comprises two or more impingement jets that supply fluid only to that particular metering outlet. Using such approach, impingement jets and metering outlets are strategically spaced and configured to provide a cooling of the transition that achieves desired cooling effects for respective particular regions of a transition, and that is predominantly due to impingement cooling rather than to convective and/or film cooling. This contrasts with existing cooling approaches in which impingement cooling is an incidental byproduct of the design, and where the cooling effect, rate or proportion attributable to impingement cooling is small relative to convective, or convective and film cooling effect, rate or proportion.

Further, in some embodiments, the arrangement and dimensions of the impingement jets and the metering outlets are such that, during operation, a substantially uniform cooling of, and a desired uniform temperature of, the transition results. This allows a transition to meet a determined low cycle fatigue component life requirement. In other embodiments, certain regions exposed to less heat may be designed to be provided less cooling by the approaches of the present invention than other regions in greater need of cooling. Generally, designs of transitions in accordance with the present invention provide more cooling effectiveness, and in some of these embodiments also more efficient use of the cooling fluid, such as cooling air. The present invention in various embodiments also advantageously reduces cooling air consumption, decreases cross flow mass flux ratio, and also may maintain a desired, more optimized static pressure in the cooling channels.

In various embodiments these results are achieved through an improvement in the relationship, along a cooling channel, of the respective cooling flows from the impingement jets and the accumulating cross flow from other, more upstream-positioned impingement jets. Part of the improvement relates to a particular metering outlet receiving cooling fluid from impingement jets that are arranged on different sides of the channel relative to the metering outlet. Also, in various embodiments the cross flow degradation of the impingement flow from an impingement jet closest to a particular metering outlet is held within a determined relationship with the cross flow degradation of the farthest upstream impingement jet that also supplies the metering outlet from the same direction.

Prior to discussing these aspects in more detail, however, a brief review is provided of a common arrangement of elements of a prior art gas turbine engine into which may be provided embodiments of the present invention, and of a prior art cooling channel design. FIG. 1A provides a schematic cross-sectional depiction of a prior art gas turbine engine 100 such as may comprise various embodiments of the present invention. The gas turbine engine 100 comprises a compressor 102, a combustor 107, a combustion chamber 108 (the latter two may be arranged radially in a can-annular design), and a turbine 110. During operation, in axial flow series, compressor 102 takes in air and provides compressed air to a diffuser 104, which passes the compressed air to a plenum 106 through which the compressed air passes to the combustor 107, which mixes the compressed air with fuel (not shown), and directly to the combustion chamber 108, and thereafter largely combusted gases are passed via a transition 114 to the turbine 110, which may generate electricity. A shaft 112 is shown connecting the turbine to drive the compressor 102. Although depicted schematically as a single longitudinal channel, the diffuser 104 extends annularly about the shaft 112 in typical gas turbine engines, as does the plenum 106.

Figure 1B:
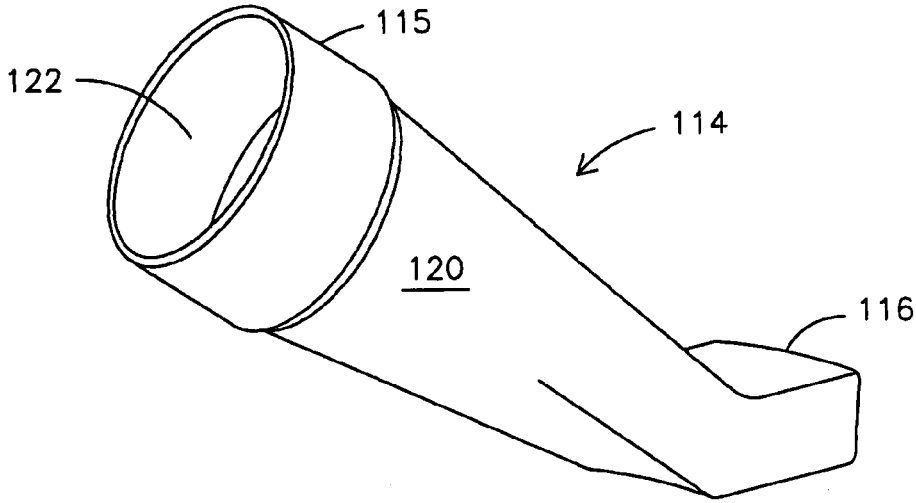
FIG. 1B provides a perspective view of one embodiment of the transition depicted schematically in FIG. 1A.

FIG. 1B provides a perspective view of one embodiment of transition 114. It is noted that this shape may be considered to be "tubular" in the sense that a surrounding transition wall 120 encloses an inner region identified as a hot gas path 122. The shape and contour of the tubular wall 120 needs not be cylindrical, and may change dimensional profile along its length, and still is considered tubular based on this function of defining an inner region, i.e., the hot gas path 122. For example, in FIG. 1 B the upstream end 115 is generally circular and the shape of the tubular wall 120 transitions to a generally rectangular exit 116. Also, it is noted that a transition alternatively referred to as a "tail pipe," "transition duct," or "combustion tube" by some in the field, partly depending on the elements upstream to this, and the term "transition" as used herein is meant to refer to a component referred to by any of these terms. One or more cooling channels of the present invention may be utilized in a tubular transition wall such as the tubular wall 120 of transition 114.

Figure 1C:
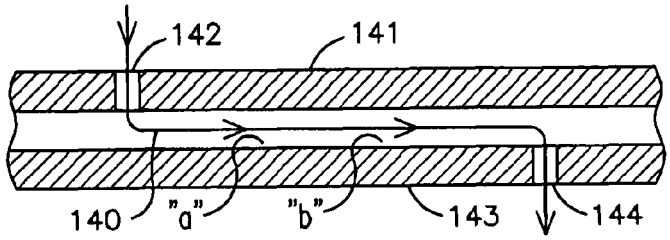
FIG. 1C (PRIOR ART)
FIG. 1C is a schematic side view of a prior art conventional cooling channel as may be found in a transition or other walled body.
Figure 1D:
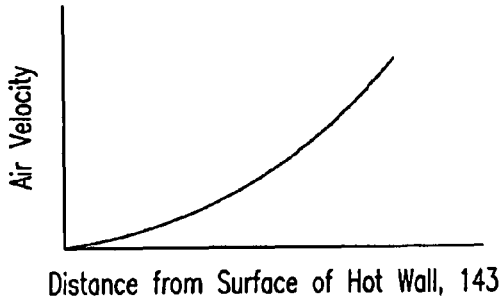
FIG. 1D (PRIOR ART)
FIG. 1D is a chart depicting air velocity over distance from a wall of FIG. 1C.

FIG. 1C presents a schematic side view of a prior art conventional cooling channel 140 as may be found in a transition or other walled body. The cooling channel 140 is defined exteriorly by an outer wall 141, and interiorly by a hot wall 143 that encloses, in part, a hot gas path (not shown, see FIG. 1B). During cooling operations of such conventional cooling channel 140, a flow of cooling air, depicted by the arrowed line, enters channel 140 through an inlet aperture 142 and exits through an outlet aperture 144. FIG. 1D provides a velocity profile chart that shows that an unperturbed flow at transects along the cooling channel 140 of FIG. 1C, such as between points a and b, provides limited cooling of hot wall 143 due to less particle flow/velocity near the hot wall 143. This reduces heat transfer efficiency along the length of hot wall 143 between the inlet aperture 142 and the outlet aperture 144. It is noted that flow from the inlet aperture 142 of FIG. 1C may, in some prior art arrangements, flow in part to a first outlet aperture (such as 144) and also flow in part to a second outlet aperture (not shown) positioned in the opposite direction from the first outlet aperture with respect to the inlet aperture. In some such arrangements a partial flow from two inlet apertures may be collected by an intermediately disposed outlet aperture. The net effect, however, nonetheless still results in the predominant cooling effect being by convective cooling rather than by impingement cooling.

Generally, it is recognized that impingement jets disturb such gradient to provide increased cooling at and near a surface to be cooled. However, conceptual, structural, and other limitations have precluded effective use of impingement jets for a transition. For example, to the extent that numerous impingement jets are placed in a transition, one generally skilled in the art may expect a lowering of the structural integrity of such transition. The development of methods for fabrication of double walled transitions, such as are described in U.S. Pat. No. 6,602,053, issued Aug. 5, 2003 to Subramanian and Keyser, has moderated such concerns due to the improved basic structural integrity based on this form of construction. Additional factors appreciated by the present inventors provided for development of the embodiments of the present invention, as described and claimed herein. It has been determined by the present inventors that a single wall construction technique, described herein, also provides for construction of a transition with numerous apertures in accordance with the present invention and sufficient structural integrity.

Figure 2:
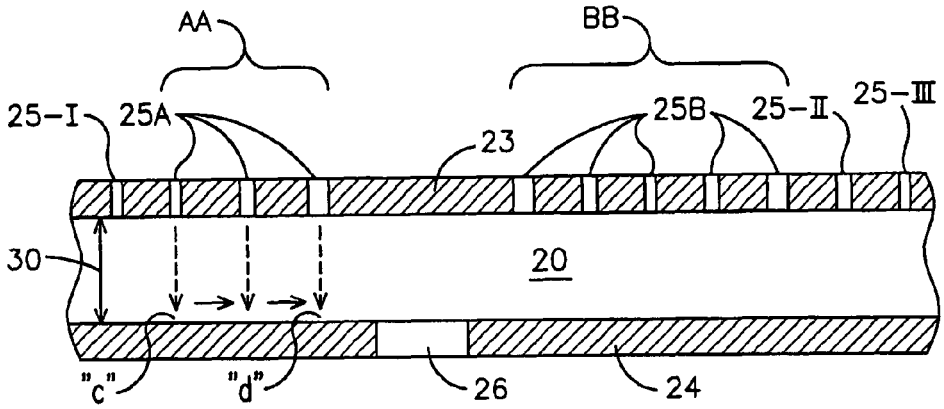
FIG. 2 provides a cross-sectional representation of a first exemplary embodiment of the present invention.

FIG. 2 provides a cross-sectional representation of a first exemplary embodiment of the present invention. A cooling channel 20 is defined by an outer wall 23 and by an inner wall 24, which form part of the enclosing tubular wall of a hot gas path of a transition (not shown in entirety, see FIG. 4). The cooling channel 20 also comprises lateral side walls, not shown in this view (see FIGS. 3 and 4), and may have end walls (not shown), such as at upstream and downstream ends of the transition for longitudinally oriented channels. The inner wall 24 may comprise a thermal barrier coating or other features as are known to those skilled in the art. A plurality of impingement jets 25 are formed through the outer wall 23, and a metering outlet 26 is formed through the inner wall 24. More particularly as to the impingement jets that supply the depicted metering outlet 26, there is a first subdomain AA to one side, comprising three impingement jets specifically identified as 25A, and there is a second subdomain BB, to the side opposite the depicted metering outlet 26, comprising five impingement jets specifically identified as 25B. This approach may be repeated for the length of the channel 20, with one or two (such as from opposite sides) subdomains supplying a respective metering outlet. For example, impingement jet 25-I is the farthest jet for a subdomain that supplies a metering outlet (not shown) further to that side of the channel 20. The same applies to impingement apertures 25-II and 25-III to the other side, however noting that in some instances a particular jet such as impingement jet 25-II may be so positioned so as to supply two metering outlets. In such case such impingement jet is not considered to be part of either adjacent subdomain.

Further to the impingement jets 25, they may be strategically spaced and configured, including by varying their size, such that a desired level of cooling may be achieved over the entire transition, or for particular regions of the transition. In some embodiments a relatively uniform cooling of the inner wall 24 is provided during normal gas turbine operations through advantageous impingement cooling at points along the surface of the inner wall 24 that defines the cooling channel 20. This may be achieved by controlling the cross flow degradation of the respective cooling air flows from the impingement jets 25. The respective size and positioning of the metering outlet 26 relative to the impingement jets 25 that supply it help maintain desired post-impingement static pressure levels. Also, it is noted that the height 30 of the channel does not change between end walls 21 and 22 and the metering outlet 26. This uniform height holds for some, but not all embodiments.

More specifically for various embodiments, during gas turbine operation a cross flow mass flux ratio may exist at each impingement jet between a cross flow and the respective impingement flow from the impingement jet. At a most upstream impingement jet relative to a sub-domain of impingement jets supplying a metering outlet, the cross flow mass flux ratio is zero, and a cross flow degradation factor is 1.0. The cross flow mass flux ratio increases for a particular more downstream impingement jet as the flow from a number of more upstream impingement jets may contribute to the local cross flow at that particular more downstream jet (e.g., see "d" in FIG. 2). Also, the degradation factor corresponding lowers from 1.0. In various embodiments the channels are designed so that the average degradation factor for a sub-domain of impingement jets is at least 0.5.

For example, the embodiment depicted in FIG. 2 is designed so average cross flow degradation factor is at least 0.5 for both sets, or sub-domains, of impingement jets 25 that are on opposite sides of metering outlet 26. In more complex designs, a number of metering outlets may be provided along a relatively long channel so that this cross flow degradation factor criterion is achieved for each sub-domain and for the entire plurality of channels and transition. Part of this design utilizes a single metering outlet to receive flows from different directions.

Additional design factors that may be used singly or in combination with one another to achieve a desired result include, but are not limited to: stream-wise spacing of impingement jets; span-wise spacing of impingement jets; spacing between impingement jets; and arrangement of impingement jets relative to spacing of metering outlets. The latter includes spacing and quantity of both metering outlets and impingement jets.

Figure 3:
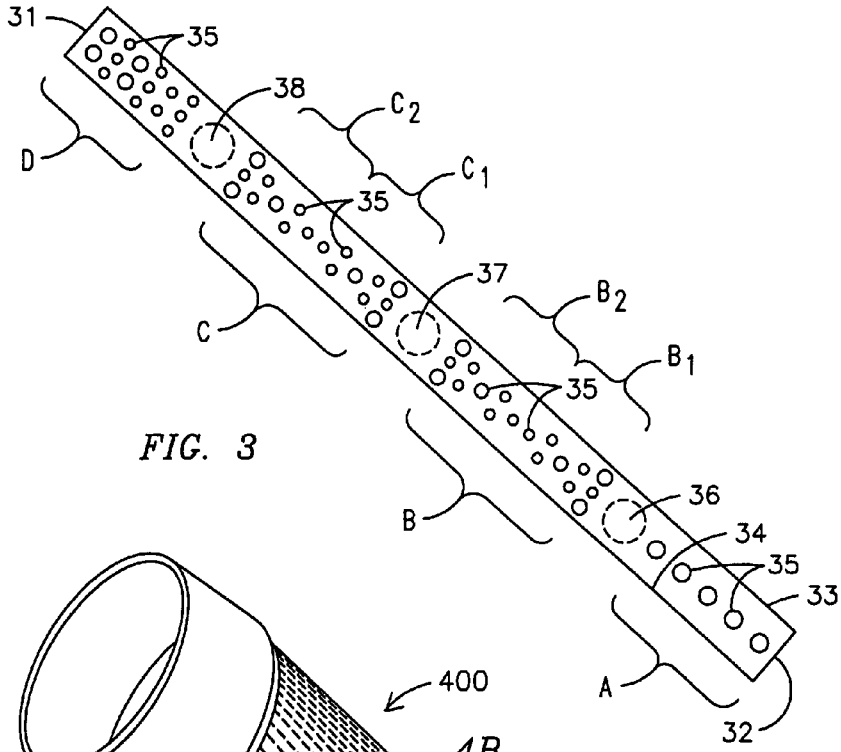
FIG. 3 provides a schematic top perspective view of a transition wall section showing various impingement jet arrangements for cooling channels of the present invention.

FIG. 3 provides a top view of a channel 30 (one of many in a transition such as shown in FIG. 1B) having three metering outlets 36, 37, 38 (shown below the surface with dashed lines) and various exemplary arrangements of impingement jets 35. The lines defining the channel represent end walls 31 and 32 and side walls 33 and 34 extending between an outer wall and an inner wall (not shown, see FIG. 2). At a first end of channel 30 is a subdomain A of impingement jets. This subdomain A of impingement jets 35 is arranged linearly and uses a single aperture size and uniform stream-wise spacing to achieve a desired predominantly impingement cooling of the wall region immediately below this subdomain, and also the region between this subdomain and metering outlet 36. Arrays B and C provide impingement jets that are arranged using aperture size, stream-wise spacing, and span-wise spacing to achieve a desired result with regard to cross-flow degradation and cooling uniformity. Array B is subdivided into a sub-domain $B_1$ and a sub-domain $B_2$. Cooling fluid from sub-domain $B_1$ flows to metering outlet 36, and contributes with the cooling fluid from array A to supply metering outlet 36. Similarly, array C is subdivided into a sub-domain $C_1$ and a sub-domain $C_2$. Cooling fluid from sub-domain $C_1$ flows to metering outlet 37, and contributes with the cooling fluid from sub-domain $B_2$ to supply metering outlet 37. Similarly, metering outlet 38 is supplied from two different directions, more particularly from two opposite directions, receiving cooling fluid both from sub-domain $C_2$ and from subdomain D. Subdomain D utilizes aperture size, stream-wise spacing, and span-wise spacing to achieve a desired result with regard to cross-flow degradation and cooling uniformity, however with a different pattern compared to arrays B and C.

Using such approaches, a transition is provided that comprises a number of impingement jets exceeding a number of metering outlets, such jets and outlets strategically spaced and configured so that the transition is effective to provide an impingement cooling rate that exceeds a convective cooling rate. That is, there is more heat removal from impingement cooling than from convective cooling. In some of such embodiments, where a film cooling also is provided, the transition is designed so as to be effective to provide an impingement cooling rate that exceeds a convective cooling rate and/or a film cooling rate. That is, in some of such latter disclosed embodiments there is more heat removal from impingement cooling than from convective cooling, or from film cooling, or from the sum of the convective cooling and the film cooling.

Also, for various embodiments, by desired result is meant the attainment an average cross flow degradation factor for all impingement jets in a channel of at least 0.5, and/or the attainment of a desired uniform temperature of the transition wall adjacent the hot gas path. Regardless of the particular impingement jet pattern and design factors that are employed in a particular transition design, a desired level and expanse of uniform impingement cooling is achieved. More generally, the arrangement of impingement jets and metering outlets provides, during operation, a substantially uniform cooling.

The arrays and sub-domains of FIG. 3 are meant to be illustrative of various alternative arrangements, are not meant to be limiting, and are not necessarily meant to be combined in a single particular embodiment. The actual pattern of impingement jets and metering outlets for a particular transition embodiment is specific to the characteristics and physical parameters of that transition. Also, it is appreciated that for various embodiments one or more channels of a transition may be contoured and/or angled, such as to conform to a non-planar surface area. Such one or more channels may have a respective metering outlet receiving cooling fluid from two or more different directions that are not linearly disposed opposite directions.

Figure 4C:
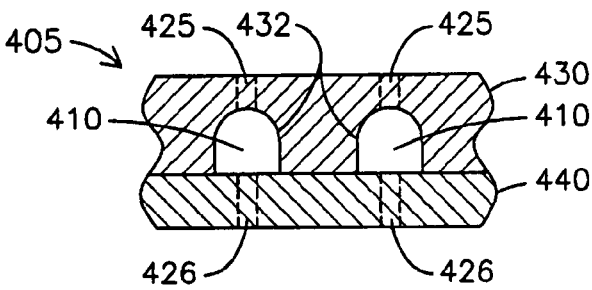
FIG. 4C provides a cross-sectional depiction, taken along line C-C of FIG. 4B, of one alternative embodiment of a transition wall structure.
Figure 4A:
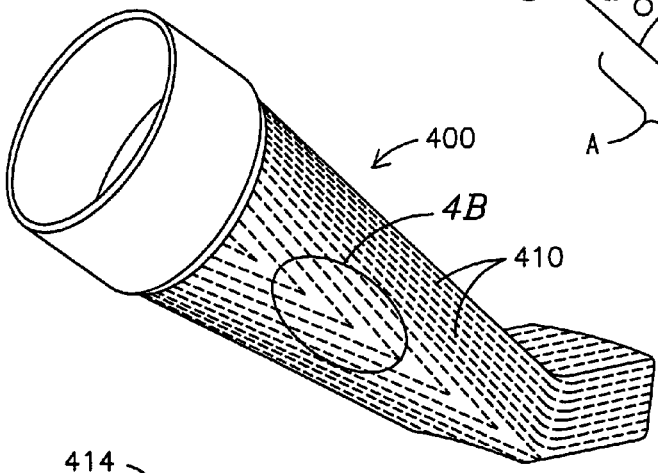
FIG. 4A depicts a transition showing a plurality of cooling channels of an exemplary embodiment of the present invention.

FIG. 4A provides a non-limiting example of such arrangement. FIG. 4A, a perspective view of a transition 400 shows that a plurality of adjacent channels 410 (side walls indicated by dashed lines, impingement jets not shown) may be arranged substantially parallel along some surfaces.

Figure 4B:
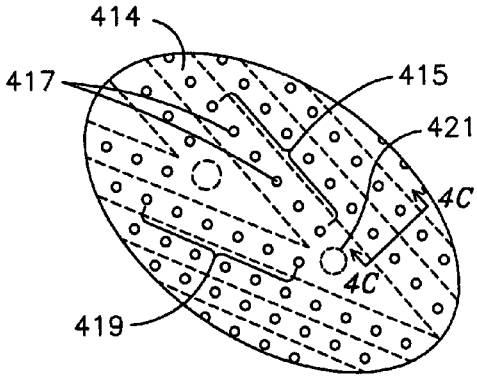
FIG. 4B provides a magnified view showing some details of one such cooling channel of FIG. 4A.

Although not viewable at this scale, the adjacent channels may be provided with arrangements of impingement jets and metering outlets as are depicted in FIGS. 2 and/or 3. As shown in the FIG. 4B enlargement of the circled area of FIG. 4A, contour effects (such as transitioning from a circular to a rectangular shape) leads to provision of some channels that have angular inflections. FIG. 4B details a channel 414 comprising a first sub-domain 415 of impingement jets 417, and a second sub-domain 419 of impingement jets 417, where a metering outlet 421 is positioned to receive cooling fluid (not shown) from two different directions (i.e., from sub-domains 415 and 419) that are not linearly disposed opposite directions (other metering outlets, shown by dashed lines, are omitted from drawing for simplification). It is also appreciated that not all channels or metering outlets in a particular transition manufactured in accordance with the present invention receive cooling fluid from two opposite directions. For example, a percentage of the channels of a transition may have one or more metering outlets that receive cooling fluid from only one direction, while another percentage of the channels of the same transition have at least one metering outlet that receives cooling fluid from at least two different directions.

Further drawing from the embodiment of FIG. 4, it is appreciated that cooling channels in a transition need not have end walls such as end walls 21 and 22 of FIG. 2, or may have end walls with multiple sub-domains provided there between. Also, the relative width and length, and linear arrangement of cooling channels substantially parallel to the longitudinal axis of the transition 400 are not meant to be limiting; any dimensions and arrangement may be effectuated in various embodiments.

Also, the term impingement jet is taken to include an aperture for a channel where the shape, diameter, length, etc. of the aperture are effective to direct a flow of cooling fluid through itself so as to form a jet-like flow cooling fluid to a structure to be cooled. Typically, though not exclusively, an impingement jet comprises a round hole of a determined diameter.

Although the initial design for a transition of the present invention may be determined by analytical modeling (employing more degrees of freedom than prior art approaches based on the above factors), or this in combination with testing actual components, embodiments of the invention advantageously are amenable to modifications after installation and operation. Thus embodiments are customizable after initial installation. For example, if one or more areas of heat degradation are detected during a routine inspection, such as by visual observation, additional impingement jets and/or metering outlets may be added to one or more channels in those areas to provide a greater cooling effect. Accordingly, a process of maintaining a uniformly cooled transition may be effectuated by installing a transition comprising one or more cooling channels according to the present invention, observing for areas of heat degradation after a period of operation, and adding one or more additional impingement jets and/or metering outlets to some of the one or more channels in those areas. The additional impingement jets and/or metering outlets may be added by simple mechanical drilling of holes through the transition in locations determined to be most appropriate to achieve the uniform cooling.

FIG. 4C provides a cross-sectional depiction, taken along line C-C of FIG. 4B, so as to exemplify one alternative embodiment of a transition wall structure, and for use to describe one particular method of manufacture of a transition wall 405 that incorporates aspects of the present invention. An outer plate 430 is shown in relation to an inner plate 440. Impingement jets are indicated by dashed lines 425 (which are out of the plane of the cross-section), and metering outlets are indicated by dashed lines 426 (which also are out of the plane of the cross-section). This provides an example, not to be limiting, of a single-wall construction of a transition that may be used for the present invention. It is appreciated that the present invention may be applied to single wall transitions such as described for FIG. 4C, or for double-wall transitions.

To construct the embodiment of FIG. 4C, grooves 432 are made by methods known to those skilled in the art to form the channels 410. The cross-sectional shape and size may be varied to provide desired results in conjunction with the strategically spaced and configured impingement jets 425 and metering outlets 426. This may include enlarging or making smaller the groove as it gets closer to a metering outlet. After formation of the grooves to partly form and define the shape of the channels 410, the impingement jets 425 and metering outlets 426 are formed. In another step, the outer plate 430 and the inner plate 440 are aligned, thus more fully defining the channels (by means of the surface of the inner plate that also partly defines the channels). Then the so-aligned outer plate 430 and the inner plate are press bonded together by use of bonding methods known to those skilled in the art, thereby forming the transition wall 405. It is appreciated that this is merely one example, and that, for instance, grooves may be provided in an inner plate rather than the outer plate 430 as depicted herein.

A further optional step is to combine sections of the transition wall 405 made by the above method to form a complete transition. For instance, a number of wall sections may be welded or otherwise joined together to form a complete transition. Also, it is appreciated that generally smaller diameter holes for the impingement jets may be used compared to currently used impingement jet hole sizes, as more such holes are being provided. For example, in some embodiments a 0.4, 0.5, or 0.6 millimeter diameter hole may be provided for multiple impingement jets of the present invention in place of fewer larger holes in the range of 2.5 to 3.5 millimeter diameter.

It is noted that the surface of the inner plate 440, or of an inner wall as described above, that defines the hot gas path within the transition, is generally referred to as the interior surface, whether of a single wall or double wall transition.

Generally, the above approaches are noted to differ from the use of a separate impingement plate or sleeve surrounding a transition, and with uses of baffle plates.

All patents, patent applications, patent publications, and other publications referenced herein are hereby incorporated by reference in this application in order to more fully describe the state of the art to which the present invention pertains, to provide such teachings as are generally known to those skilled in the art. While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

What is claimed is:

1. A transition for a gas turbine engine comprising:

a tubular wall comprising an exterior surface, an interior surface, and defining a hot gas path interior to the interior surface;

a plurality of channels disposed within the wall; two or more subdomains of impingement jets communicating between the exterior surface and one channel of said plurality of channels, each such subdomain comprising two or more impingement jets; and one or more metering outlets intermediate a length of the channel communicating between said one channel and the interior surface;

wherein the impingement jets of each respective subdomain are designed to supply cooling fluid to only one of the one or more metering outlets;

the transition being positioned between a combustion chamber can and a turbine of the gas turbine.

2. The transition of claim 1, wherein average cross flow degradation factor for the impingement jets is at least about 0.5.

3. The transition of claim 1, wherein one of the one or more metering outlets receives cooling fluid from two different subdomains of impingement jets positioned in opposite directions along a linear channel from the one metering outlet.

4. The transition of claim 1, additionally comprising at least one cooling channel comprising a metering outlet not positioned relative to the impingement jets to receive cooling fluid from two different directions along the channel.

5. A gas turbine engine comprising the transition of claim 1.

6. The transition of claim 1, the interior surface comprising a thermal barrier coating between the metering outlets.

7. A transition for a gas turbine engine comprising:

a cooling channel comprising an outer wall, an inner wall, first and second opposed side walls, a length, and a width;

a metering outlet passing through the inner wall of the cooling channel intermediate the length of the cooling channel;

two subdomains of impingement apertures, each subdomain comprising a plurality of impingement apertures that pass through the outer wall of the cooling channel;

wherein the two subdomains are disposed on respective opposite sides of the metering outlet along the cooling channel, and supply a cooling fluid only to said metering outlet from opposite directions along the cooling channel;

the transition being positioned between a combustion chamber can and a turbine of the gas turbine.

8. The transition of claim 7, wherein the impingement apertures in at least one of the subdomains vary in size, number, length-wise spacing, and width-wise spacing effective to provide an impingement cooling rate of the inner wall of the channel that exceeds a convective cooling rate thereof.

9. The transition of claim 8 further comprising a plurality of metering outlets spaced lengthwise along the inner wall of the cooling channel intermediate the length of the cooling channel, and a respective plurality of pairs of subdomains of impingement apertures, wherein each pair of subdomains comprises first and second subdomains disposed on respective opposite sides of one of the metering outlets, the first and second subdomains supplying the cooling fluid only to said one of the metering outlets from opposite lengthwise directions along the cooling channel.

10. The transition of claim 9 further comprising multiple adjacent channels formed according to claim 9 wherein the impingement apertures are spaced and configured effective to provide an impingement cooling rate of the inner walls of the channels that exceeds the sum of a convective cooling rate and a film cooling rate thereof, and wherein each of the subdomains has an average degradation factor of at least 0.5.

* * * * *